US006508388B1

(12) United States Patent
Louw

(10) Patent No.: US 6,508,388 B1
(45) Date of Patent: Jan. 21, 2003

(54) HANGER

(76) Inventor: Henry John Louw, Dreyersdal Road, Bergvliet 7900 (ZA)

( * ) Notice: Subject to any disclaimer, the term of this patent is extended or adjusted under 35 U.S.C. 154(b) by 0 days.

(21) Appl. No.: 09/575,408

(22) Filed: May 22, 2000

(30) Foreign Application Priority Data

May 21, 1999 (ZA) ..... 99/3465

(51) Int. Cl.[7] ..... A47G 25/48
(52) U.S. Cl. ..... 223/96
(58) Field of Search ..... 223/96, 93, 91, 223/90; 24/330, 331, 338, 495, 536

(56) References Cited

U.S. PATENT DOCUMENTS 928,086 A * 7/1909 Viganego ..... 223/96
2,496,531 A * 2/1950 Gray ..... 223/96
3,593,897 A * 7/1971 Knox ..... 223/96
5,082,153 A * 1/1992 Duester et al. ..... 223/96
5,516,014 A * 5/1996 Garrison et al. ..... 223/96
6,047,868 A * 4/2000 Petrou et al. ..... 223/96

* cited by examiner

*Primary Examiner*—Bibhu Mohanty
(74) *Attorney, Agent, or Firm*—Ostrolenk, Faber, Gerb & Soffen, LLP

(57) ABSTRACT

A hanger with a locking mechanism to secure gripping members can be disengaged with a user operated lever. The gripping members engage and securely retain an item such as an article of clothing when the locking mechanism is engaged. A tab located on the gripping members acts as a lever and disengages the locking mechanism with decreased effort by an individual user. With this structure, the item can be easily secured to the hanger by engaging the locking mechanism, and freed by easily disengaging the locking mechanism by operation of the tab.

14 Claims, 1 Drawing Sheet

HANGER

CROSS-REFERENCE TO RELATED APPLICATIONS

This application claims the benefit of, and priority to, South African provisional patent application number 99/3465, filed May 21, 1999.

BACKGROUND OF THE INVENTION

1. Field of the Invention

The present invention relates to a hanger, and more particularly, to a clothes hanger having a release mechanism.

2. Description of the Related Art

Presently, many different types of hangers are available for displaying and organizing clothing or other items in a retail shop or warehouse. Generally, these hangers have a hook to suspend the hanger and item from a bar. With this structure, the hanger and item can be slid along the bar together with other hangers suspending items. These type of hangers generally have a transverse support member such as a bar or dowel to which the hook is attached.

One type of hanger of interest has gripping members on either end of the hanger bar for gripping clothing. In these hangers, the gripping members are usually hinged extensions which can pivot into a closed position to grip the item of clothing. The closed position can be maintained with a resilient spring clip, which can be engaged or disengaged to secure the hinged extensions in place. The clip can be formed with the hanger to permit the clip to snap into place on the gripping member, and remain fixed in place until a user wishes to release the item of clothing from the grip. When it is desired to remove the article from the hanger, the clip is moved from its engaged position, and the hinged extensions are free to pivot into an open position.

While the above described type of hanger is useful in reliably securing articles of clothing to the hanger for suspension or storage, situations arise in which it is difficult to move the clip from the engaged position. It is fairly easy to move the clip to the location where the clip snaps into the secured position, by applying increasing pressure. Once in place, however, a large directed force is required to "unsnap" the clip. This force is greater than the force required to move the clip into the engaged position where the clip easily slides into place. To unsnap the clip, the end of the clip must be disengaged from a corresponding lip formed on the gripping member. It is often difficult to apply the proper amount of force in the proper direction to unsnap and disengage the clip. This difficulty occurs because it is often hard to direct the right amount of force in the proper direction with a person's fingers. Thus, when a person attempts to unsnap the clip with their fingers, the process can be awkward and troublesome.

SUMMARY OF THE INVENTION

According to an embodiment of the present invention, there is provided a hanger for hanging an item comprising a support member and at least one clasp disposed on the support member. The clasp is movable between a closed position where the clasp is effective to retain the item, and an open position. The clasp also includes a releaseable locking mechanism that is effective to retain the clasp in the closed position when the locking mechanism is engaged. The clasp also includes a release wherein actuation of the release is effective to disengage the locking mechanism thereby permitting the clasp to move to the open position.

Advantageously, the release comprises a lever pivotably coupled to the hanger at a pivot point. The lever disengages the locking mechanism when the lever is pivoted about the pivot point.

According to another embodiment of the present invention, there is provided a disengagement mechanism for a hanger having a locking mechanism to secure a gripping member. The disengagement mechanism comprises a catch on the gripping member, a locking member movable into a position effective to engage the catch and a user operable release. The release operates to disengage the locking member from the catch thereby permitting the locking member to be moved into a position to free the gripping member.

Advantageously, the locking member is resilient, and engagement of the locking member urges the gripping member into the closed position.

Preferably, the release is a resilient lever and the lever contacts and urges the locking member to a position disengaged from the catch.

According to another embodiment of the present invention, there is provided a hanger comprising a support bar, at least one gripping member movable between an open and closed position on the support bar, means for securing the gripping member in a closed position and a release member on the gripping member. The release member is operable to disengage the means for securing.

According to a method embodied in the present invention, there is provided a method of disengaging a locking mechanism securing a gripping member on a hanger comprising the steps of:

pivoting a lever pivotally attached to the gripping member;

contacting the locking mechanism with an end of the lever; and moving the locking mechanism to a disengaged state with respect to a locking catch.

The above features and advantages of the present invention will become apparent from the following description read in conjunction with the accompanying drawings, in which like reference numerals designate the same elements.

BRIEF DESCRIPTION OF THE DRAWING(S)

DETAILED DESCRIPTION OF THE PREFERRED EMBODIMENTS

Figure 1:
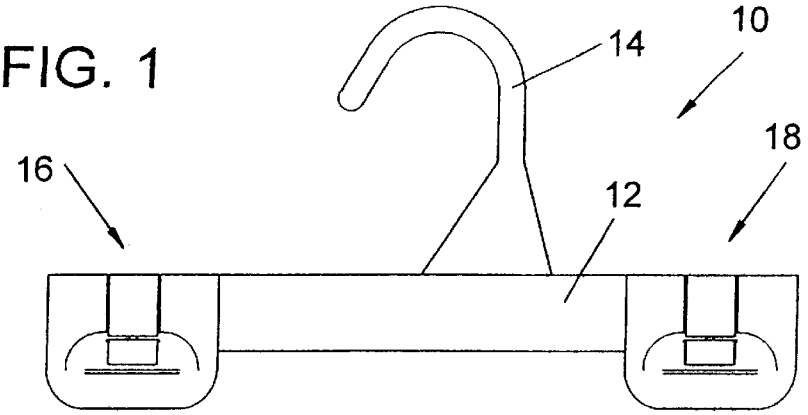
FIG. 1 is a front view of a hanger according to the present invention.

Referring now to FIG. 1, a hanger in accordance with the present invention is generally indicated at 10. The hanger 10 includes a support bar 12 provided with a hook attachment 14. The hook, the support bar 12 and the gripping members 16, 18 can be made of any of the known materials by any of the known methods, e.g., plastic materials by injection molding. The gripping arrangements 16, 18 can be formed integrally with the support bar 12. The gripping arrangements 16, 18 may also be formed of the same material as the support bar 12. Moreover, any number of gripping arrangements 16, 18 may be provided, e.g. one at either end of the support bar 12. The gripping arrangements 16, 18 may be composed of a material suitable for preventing slippage of a gripped item.

Figure 2:
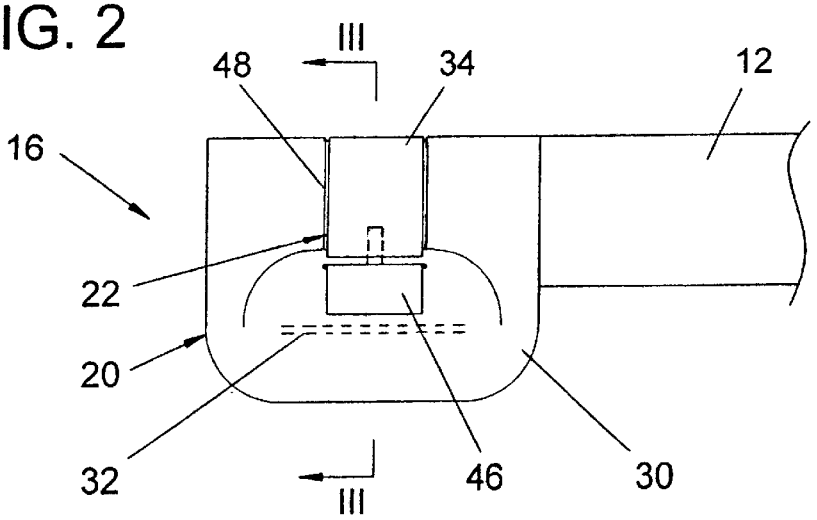
FIG. 2 is an enlarged front view of a gripping member of the hanger of FIG. 1.
Figure 3:
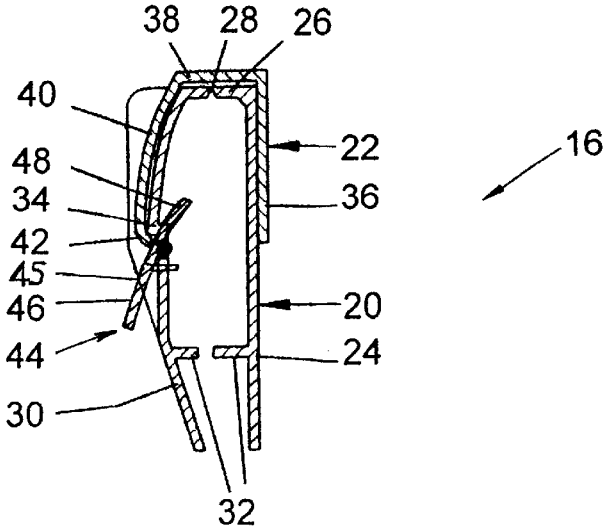
FIG. 3 is a sectional side view of the gripping member of FIG. 2 taken along arrows III—III of FIG. 2.

Referring to FIGS. 1–3, the hook attachment 14 is connected to the support bar 12 and extends upwardly. Two gripping members 16, 18 are provided on either end of the support bar 12 to receive and secure an article of clothing. It should be evident that the gripping members 16, 18 function in the same way, and only gripping member 16 will be described here.

Referring now to FIGS. 2 and 3, an enlarged view of the gripping member 16 is shown. The gripping member 16 includes a gripping clip 20 and a U-shaped spring fitting 22 made of metal, or other resilient material. The gripping clip 20 is invertedly U-shaped and has a rear leg 24 formed integrally with the bar 12. A transverse bridge 26 extends from the upper edge of the rear leg 24. The bridge 26 includes a weakened zone defining a hinge connection 28. A front leg 30 extends downward from the bridge 26 substantially parallel to the rear leg 24. While the gripping clip 20 is illustrated as a resilient U-shaped band, it should be evident to an artisan of ordinary skill that other structures can be used equivalently. Such equivalent structures can include but are not limited to a peg in a compression fit opening, a butterfly clamp, and other items available to one skilled in the art to accomplish the gripping function.

The rear leg 24 and the front leg 30 are provided with protrusions 32. The protrusions 32 extend from inner surfaces of the rear leg 24 and the front leg 30 toward each other. When the gripping member 16 is in a closed position, protrusions 32 oppose each other and cooperate to secure an article of clothing there between.

The front leg 30 is further provided with a lip 34 on an outward surface for retaining the spring fitting 22 in an engaged position. A portion of the outer surface of the front leg 30 is sloped downward and away from a plane of the rear leg 24. Alternatively, or in addition, the outer surface of the front leg 30 can have a protrusion.

The spring fitting 22 is substantially U-shaped in side view and is adapted to slide over the gripping clip 20 and to fit tightly thereon, thereby engaging gripping member 16 in the closed position. The spring fitting 22 can be made of any of the known materials such as plastics or metal, e.g. spring steel.

The spring fitting 22 includes a first leg 36, a bridge 38 and a second leg 40, the second leg 40 having a bent end 42. The first leg 36 is adapted to abut against the rear leg 24 while the second leg 40 is adapted to abut against the front leg 30. The spring fitting 22 is held in place against gripping clip 20 by means of the end 42 which can hook over the lip 34.

The gripping member 16 further includes a release mechanism 44 to release spring fitting 22 from fitting tightly over gripping clip 20, i.e. to release gripping mechanism 16 from the closed position. Preferably, the release mechanism 44 includes a lever 45 pivotally mounted on the front leg 30 of the gripping clip 20 and adapted to lift the spring fitting 22 off the gripping clip 20. In particular, lever 45 of release mechanism 44 is hingedly joined to the front leg 30 at pivot point 47. The lever 45 includes a tab 46 which can be operated by an individual, and an elongated protrusion 48 extending from the tab 46. When pressed by an individual, the protrusion 48 is adapted to press against the end 42 and to release the end 42 from the lip 34.

It should be realized by those skilled in the art that the release mechanism 44 can be constructed in any manner, just so long as the release mechanism releases spring fitting 22 from fitting tightly over gripping clip 20. For example, the release mechanism 44 may be adapted to remove the spring fitting 22 from the gripping clip 20. The release mechanism 44 may itself be resilient and act as a spring to return to an original position after disengaging the spring fitting 22. In a further example, the release mechanism 44 can be made as a sliding mechanism where the release mechanism includes a wedge portion that is adapted to slide between the end 42 and the lip 34, thereby disengaging the end 42 from the lip 44.

Referring back now to FIGS. 1–3, in use, an article of clothing is hung up, or suspended, with the hanger 10 by gripping the clothing with the gripping members 16, 18. Before an item is secured to the hanger, the gripping members 16, 18 are in an open position. In the open position, the gripping clip 20 is open, with the front leg 30 pivoted away from the rear leg 24. The clothing is placed against the rear leg 24 between the rear leg 24 and the front leg 30. The front leg 30 is then swivelled at the hinge connection 28 toward the rear leg 24 so that the protrusions 32 can grip the clothing.

To close the gripping member 16, the spring fitting 22 is placed over the gripping clip 20 and slid downward such that the front leg 30 is forced towards the rear leg 24. As the spring fitting 22 slides down the gripping clip 20, the slope or protrusion on the outer surface of the front leg 30 helps to increase the force applied by the spring fitting 22, which in turn increases the force urging the front leg 30 toward the rear leg 24. Since the spring fitting 22 is resilient, sliding the spring fitting 22 downward does not require excessive force. The resiliency of the spring fitting 22 also helps to improve the force applied between the front leg 30 and the rear leg 24. As the spring fitting 22 is moved toward the base of gripping member 16, the end 42 moves beyond and clears the edge of the lip 34. After clearing the edge of the lip 34, the end 42 snaps into place abutting lip 34. The spring fitting 22 now engages and secures gripping members 16, 18.

When it is desired to remove the clothing from the hanger 10, pressure is applied to the tab 46 thereby causing the tab 46 to swivel around its pivot point 47. As the tab 46 swivels, the protrusion 48 presses against the end 42 of the spring fitting 22. Consequently, the end 42 shifts outward as pressure is applied from the protrusion 48, and eventually clears the lip 34. Once the end 42 clears the lip 34, the spring fitting 22 is released and can be easily slid in an upward direction. As the spring fitting 22 slides upward, the distance between the first leg 36 and the second leg 40 decreases due to the slope of the outer surface of the front leg 30. The combination of the resiliency of the spring fitting 22 and the slope or protrusion on the front leg 30 contribute to urge the spring fitting 22 upward. The force applied by the spring fitting 22 decreases as the first leg 36 and the second leg 40 are permitted to approach each other. As the spring fitting 22 continues to slide upward, the front leg 30 is released, permitting the gripping members 16, 18 to be opened. The front leg 30 is swivelled upwards away from the rear leg 24 about the hinge connection 28 and the clothing can be removed.

In summary, by providing a release easily operated by an individual user, a securing mechanism for a gripping member on a hanger can be easily disengaged. This provision permits the hanger to be used more quickly and reliably, with less effort on the part of the individual user.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention.

What is claimed is:

1. A hanger comprising:

a support member;

a clasp disposed on said support member, said clasp movable between a closed position where said clasp is effective to hold an item therein, and an open position;

a releaseable locking mechanism, said locking mechanism being engageable with said clasp to retain said clasp in said closed position, and disengageable from said clasp to permit said clasp to be moved to the open position; and a release lever, said release lever being:

separate from both said clasp and said locking mechanism;

pivotably coupled to said hanger at a pivot point for movement relative to both said clasp and said locking mechanism; and operative to disengage said locking mechanism from said clasp when said lever is pivoted about said pivot point thereby permitting said clasp to move to said open position.

2. A hanger according to claim 1, wherein:

said locking mechanism includes a spring member that urges said clasp to the closed position when said locking mechanism and said clasp are engaged.

3. A hanger according to claim 1, wherein said locking mechanism is comprised of an inverted U-shaped spring which is slidable onto said clasp to engage said locking mechanism with said clasp, and slidable off said clasp when said locking mechanism is released from its operative position.

4. A hanger according to claim 1, wherein said clasp comprises:

a first leg;

a second leg; and a hinge integral with said first and second legs, the hinge being operative to permit said first and second legs to move relatively toward each other to close the clasp, and to move relatively away from each other to open the clasp.

5. A hanger according to claim 4, further comprising:

a protrusion on an outer surface of at least one of said legs, said resilient member being slidable over said protrusion to engage said locking with said clasp.

6. A hanger according to claim 4, wherein said hinge comprises a portion of the clasp that exhibits greater flexibility than the portions that comprise said legs.

7. A hanger according to claim 1, wherein said release lever is attached at its pivot point to said clasp.

8. A hanger according to claim 1, wherein an outer surface of the clasp includes a lip and the locking mechanism includes a hook which engages said lip to secure said locking mechanism and said clasp together.

9. A hanger, comprising:

a support;

a gripping mechanism mounted on said support, said gripping mechanism being movable between an open and closed position;

a securing mechanism movable between an operative position in which said securing mechanism applies a biasing force to said gripping mechanism in a closed position and an inoperative position in which said securing mechanism does not apply a biasing force to said gripping mechanism in the closed position; and a release mechanism, said release mechanism being separate from both said gripping mechanism and said securing mechanism, and movable relative to both said gripping mechanism and said securing mechanism to move said securing mechanism from its operative position toward its inoperative position.

10. A hanger according to claim 9, wherein said securing mechanism is comprised of a resilient member that applies a closing force to said gripping mechanism when said securing mechanism is in the operative position.

11. A hanger according to claim 9, wherein:

said gripping member includes a first element and an opposed second element, said first and second elements being movable relative to each other to open and close said gripping mechanism.

12. A hanger according to claim 9 wherein said securing mechanism is separable from said gripping mechanism when in the inoperative position.

13. A hanger according to claim 9, wherein said securing mechanism includes a resilient member which is slidable onto said gripping member to place said securing mechanism in its operative position and sidable off said gripping member to place said locking mechanism in its inoperative position.

14. A hanger according to claim 9, wherein said release member comprises a lever pivotably coupled to said gripping member about a pivot point.

* * * * *